US011891263B2

(12) United States Patent
Morelli et al.

(10) Patent No.: US 11,891,263 B2
(45) Date of Patent: Feb. 6, 2024

(54) INTERFOLDING MACHINE

(71) Applicant: VALMET TISSUE CONVERTING S.R.L., Porcari (IT)

(72) Inventors: Alessandro Morelli, Lucca (IT); Sergio Lombardi, Viareggio (IT); Paolo Casotti, Lucca (IT)

(73) Assignee: VALMET TISSUE CONVERTING S.R.L., Porcari (IT)

( * ) Notice: Subject to any disclaimer, the term of this patent is extended or adjusted under 35 U.S.C. 154(b) by 0 days.

(21) Appl. No.: 17/762,176

(22) PCT Filed: Sep. 23, 2020

(86) PCT No.: PCT/IB2020/058900

§ 371 (c)(1),
(2) Date: Mar. 21, 2022

(87) PCT Pub. No.: WO2021/059164

PCT Pub. Date: Apr. 1, 2021

(65) Prior Publication Data

US 2022/0371853 A1 Nov. 24, 2022

(30) Foreign Application Priority Data

Sep. 23, 2019 (IT) ..... 102019000017048

(51) Int. Cl.

| | |
|---|---|
| ***B65H 45/24*** | (2006.01) |
| ***B65H 29/24*** | (2006.01) |
| ***B65H 45/28*** | (2006.01) |

(52) U.S. Cl.
CPC ..... *B65H 45/24* (2013.01); *B65H 29/243* (2013.01); *B65H 45/28* (2013.01);
(Continued)

(58) Field of Classification Search
CPC ..... B65H 29/243; B65H 45/28; B65H 45/24
See application file for complete search history.

(56) References Cited

U.S. PATENT DOCUMENTS 6,228,014 B1 * 5/2001 De Matteis ..... B65H 29/56 493/425
9,371,209 B2 * 6/2016 Walsh ..... B65H 45/24
(Continued)

FOREIGN PATENT DOCUMENTS

CN 2488451 Y 5/2002

*Primary Examiner* — Patrick H Mackey
(74) *Attorney, Agent, or Firm* — Maschoff Brennan

(57) ABSTRACT

An interfolding machine produces interfolded sheets according to an interfolding configuration and, starting from a web of paper provides a feeding section, which applies a tension on the web and moves the same along a feeding direction feeding the same to a cutting section, in which the web of paper is cut into a series of sheets at a cutting point between a cutting roller and a counter-cutting element. Downstream of the cutting section, a folding section includes a first and a second folding rollers counter-rotating with respect to each other. The first and second folding rollers rotate about respective rotation axes with a first peripheral velocity vP, and fold, at a folding zone, a plurality of sheets in a plurality of panels and form the stack of interfolded sheets. The cutting roller alternately distributes the aforementioned sheets between a transfer roller and the first folding roller.

26 Claims, 7 Drawing Sheets

(52) U.S. Cl.
CPC .... *B65H 2301/121* (2013.01); *B65H 2301/17* (2013.01); *B65H 2701/1924* (2013.01)

(56) References Cited

U.S. PATENT DOCUMENTS

| | | | | |
|---|---|---|---|---|
| 9,388,016 | B2 * | 7/2016 | De Matteis | B65H 45/24 |
| 9,862,562 | B2 * | 1/2018 | Butterworth | B65H 45/24 |
| 2012/0165174 | A1 | 6/2012 | Butterworth | |

* cited by examiner

INTERFOLDING MACHINE

FIELD OF THE INVENTION

The present invention relates to the production of paper material in stacks of sheets, in particular stacks of interfolded sheets, and relates to a structure of a machine for interfolding such sheets.

The invention also relate to a method for producing stacks of such products of interfolded sheets.

DESCRIPTION OF THE PRIOR ART

As it is known, in the paper industry different types of machines and processes exist for producing tissues, towels and similar products into stacks of sheets of a determined height.

In many cases the stacks are obtained by folding the sheets in an "interfolded" way, i.e. at each fold a wing of the previous sheet and a wing of the next adjacent downstream sheet are overlapped to each other. In this way, when a sheet is extracted from the stack, at the moment of the use, also a wing of the next adjacent downstream sheet is extracted, with subsequent ease for certain types of users. Among the different possible way to fold the sheets, the "L", or "V" types, with 2 panels (single-fold), or the "Z", or "W" types, respectively with 3 and 4 panels (multi-fold) are known.

In other cases the stacks are obtained not folding the sheets in an interfolded way, by folding sheets that are not overlapped to each other, or sheets that are overlapped to each other but taking from the side such that no panel of a previous sheet is closed in a wing of the immediately following sheet.

The interfolding machines normally provides to unwind a web of paper from a roll of paper. The web of paper is cut into sheets of predetermined length which are then fed overlapped with each other for a predetermined portion to counter-rotating folding rollers.

More precisely, as for example described in U.S. Pat. No. 6,228,014, the cutting into sheets of the webs is carried out on cutting rollers which alternately operate in combination with respective counter-blades. In the case of interfolded of "L" type (single-fold) the webs are cut in such a way to form a shifted succession of sheets coming from two different directions. Then, the sheets coming from one or the other direction are alternately fed to the folding rollers in such a way that each sheet coming from a first direction is overlapped with a portion of the sheet coming from the second direction, and vice versa. In general, the overlap is about of half a sheet.

In the case of interfolding machines of "Z" or "W" type (multi-fold) a single web of paper is fed which is cut forming a continuous stream of single sheets of predetermined length. The sheets are then staggered, i.e. partially overlapped to each other in such a way to form a stream of sheets partially overlapped to each other which is fed to a couple of counter-rotating folding rollers.

Other types of prior art interfolding machines can produce both single-fold interfolded sheets, i.e. of the "L", or "V", type, and stacks of multi-fold interfolded sheets, i.e. of "Z", or "W" type. In the case the machine produces stacks of interfolded sheets of "L", or "V" type, it, generally, provides a series of rollers comprising a cutting roller, which alternately distributes the cut sheets towards a first, or a second, feeding line. Each feeding line feeds the sheets to respective folding rollers which, therefore, provide to fold, or interfold, the sheets according to a set modality of work. Between the cutting roller and one of the folding rollers a transfer group is provided comprising a series of rollers which provide a difference in the length Dl between the path of the second feeding line and the path of the first feeding line. In this way, the sheets of the first and of the second feeding line reach the folding section shifted from each other of the portion necessary to provide the desired interfolding configuration. The transfer group has the function to elongate the path of the feeding line in which they are provided with respect to the other feeding line, of a length Δ1 that is half sheet, or a length that is odds multiple of half sheet, for example a sheet and half, or two sheets and half. In the case the machine produces folded products of "Z" or "W" type, the cutting roller feeds only a line of the machine where the partial overlapping is provided with the stream of sheets which are successively fed to the couple of folding rollers. However, overall, this type of interfolding machines downstream of the cutting have at least 8 rollers. Machines of this type are for example described in EP2462044.

Therefore, this type of interfolding machines are constructively complex and are not fit to be subjected to frequent maintenance operations, because the disassembly and the assembly operations of the different parts of which is constituted need long time to be completed.

In the single-fold machines, the two webs of paper are unwound from two rolls. The two webs of paper are fed to two cutting rollers to form two stream of sheets of predetermined length. The two cutting rollers cooperate with two counter-rotating folding rollers to feed the two streams of sheets in a staggered way, i.e. in such a way to obtain an overlapping of a portion of the sheets necessary to obtain the desired interfolding configuration. In this type of machine it is, therefore, necessary to have two unwinders for each web of paper, and in case two embossing groups in case of embossed products. These machines have, therefore, high costs of maintenance. Furthermore, these machines are not flexible because they can be used to obtain only a product formed by sheets folded one time i.e. comprising two panels. Machines of this type are, for example, described in the patents EP1630118, EP0982256.

SUMMARY OF THE INVENTION

It is, therefore, an object of the present invention to provide an improved machine for interfolding sheets that is able to overcome the aforementioned drawbacks of the interfolding machines of prior art.

It is in particular an object of the present invention to provide a machine for interfolding sheets which allows to simplify and velocity up the assembly and disassembly operations of the different parts of which it is constituted in order to allow to frequently carry out maintenance operations.

It is also an object of the present invention to provide a machine for interfolding that is able to produce both stacks of sheets with a single fold (single-fold) and stacks of sheets with more than one fold (multi-fold) that is structurally simplified, has a reduced encumbrance, and a reduced vacuum consumption, with respect to the prior art machines.

It is furthermore an object of the present invention to provide a method for producing stacks of interfolded sheets having analogous advantages.

These and other objects are achieved by the interfolding machine, according to the invention, for producing stacks of interfolded sheets starting from a web of paper, or similar material, said machine comprising:

a feeding section configured to cause said web of paper to move along a predetermined feeding direction;

a cutting section comprising a cutting roller and a counter-cutting element configured to cut the web of paper in a plurality of sheets of predetermined length;

a folding section comprising a first and a second folding rollers counter-rotating one with respect to the other, said first and second folding rollers being configured to fold, at a folding zone, said plurality of sheets in a plurality of panels and to form a stack of interfolded sheets according to a predetermined interfolding configuration;

whose main characteristic is that said cutting roller is, furthermore, configured to alternately distribute said plurality of sheets to said first folding roller forming a first plurality of sheets arranged to reach said folding zone through a first feeding path, and to a transfer roller of transfer section forming a second plurality of sheets arranged to reach said folding zone through a second feeding path, said transfer roller being configured to transfer said second plurality of sheets to said second folding roller.

Other features of the present invention and related embodiments are set out in the dependent claims.

In particular, the cutting roller and the transfer roller are counter-rotating one with respect to the other.

Advantageously, the cutting roller can be provided with:

first holding elements per hold the sheets on a first portion (d1) of the external surface of the cutting roller, second holding elements per hold the sheets on a second portion (d2) of the external surface of the cutting roller, in particular positioned downstream of the first portion along a feeding direction of the sheets through the machine.

More in particular, the second holding elements can be configured to hold the sheets only at predetermined angular positions of the cutting roller. In this way, when the cutting roller is arranged at these angular positions, the second holding elements are arranged to hold the sheets on the second portion in order to feed a sheet to the second plurality of sheets on the second feeding path, whilst, when the cutting roller is not arranged at these angular positions, the second holding elements are not arranged to hold the sheets on the second portion of the cutting roller and the sheet is fed to the first folding roller.

In particular, the transfer roller can be provided with third holding elements configured to hold the second plurality of sheets on the external surface. More in particular, the third holding elements can be configured to alternatively move between an activation configuration, in which are arranged to hold the second plurality of sheets on the external surface, and a deactivation configuration, in which the third holding elements are not arranged to hold the sheets and, therefore, all the sheets of the plurality of sheets are arranged to be transferred from the cutting roller to the first folding roller.

Advantageously, can an activation/deactivation device can be provided configured to arrange the third holding elements in the aforementioned activation configuration, or in the aforementioned deactivation configuration.

According to an embodiment of the invention, the second holding elements can be configured to move between a activation configuration, in which are arranged to hold the sheets on the second portion d2, and a deactivation configuration, in which the second holding elements are not arranged to hold the sheets on the second portion d2, per cui all the sheets of the plurality of sheets are arranged to be transferred from the cutting roller to the folding zone through the first feeding path.

In particular, an additional activation/deactivation device can be provided configured to alternatively arrange the second holding elements in the aforementioned activation configuration, or in the aforementioned deactivation configuration. According to an embodiment of the invention, the same activation/deactivation device can be configured to alternatively arrange both the second holding elements of the cutting roller and the third holding elements of the transfer roller in the respective aforementioned activation configuration, or in the respective aforementioned deactivation configuration.

In particular, the cutting roller and the transfer roller can have respective circumferences of equal length.

Advantageously, the cutting roller and the transfer roller can have a circumference having a length that is a multiple of the length of a sheet of the aforementioned plurality of sheets.

In particular, the cutting roller and the transfer roller can have a circumference having a length that is a multiple of the number of panels of the sheet. This configuration is particularly advantageous when the sheet 11 has 3, or 4 panels.

Advantageously, the length of the circumference of a folding roller can be a multiple of the length of a sheet.

In particular, the length of the circumference of the cutting roller can be a multiple of the length of a sheet. For example, the length of the circumference of the cutting roller can be two times the length of a sheet.

Advantageously, the length of the circumference of the transfer roller can be a multiple of a panel of a sheet. In particular, the word "panel" refers to each portion of sheet obtained by folding a sheet a determined number of times.

In particular, the first and second folding rollers can have a circumference having a length that is 4 times the length of a sheet of said plurality of sheets.

In particular, the first and the second folding rollers are arranged to rotate about respective rotation axes in such a way to have a first peripheral velocity vP, and wherein said cutting roller and said transfer roller are arranged to rotate about respective rotation axes in such a way to have a second peripheral velocity vT. More in particular, the first peripheral velocity vP is equal to half of said second peripheral velocity vT, i.e. vP=½ vT. Alternatively, according to an alternative embodiment, the first peripheral velocity $v_P$ can be equal to ⅔ of the second peripheral velocity vT, i.e. $v_P$=⅔ vT.

In particular, the first portion extends substantially from the cutting elements to a tangent point positioned between said cutting roller and said first folding roll, whilst the second portion extends substantially from said tangent point positioned between said cutting roller and said first folding roller to a tangent point positioned between said cutting roller and said transfer roller.

Advantageously, the cutting roller comprises a plurality of holes, wherein the first holding elements are configured to put in pneumatic communication the holes with a vacuum generation device at the first portion of the cutting roller in such a way to hold the sheets on the first portion and, then, to be transferred to the first folding roller, and wherein the second holding elements are configured to selectively put in pneumatic communication the holes of the cutting roller with the vacuum generation device at the second portion of the cutting roller in such a way to hold the sheets on the second portion of the cutting roller and, then, to be transferred to the transfer roller.

According to another aspect of the invention, a method for producing stacks of interfolded sheets starting from a web of paper, or similar materials provides the steps of:

feeding of said web of paper along a predetermined feeding direction;

cutting of said web of paper into a plurality of sheets of predetermined length;

folding by a first and a second folding rollers counter-rotating one with respect to the other said sheets at a folding zone to form said stack of interfolded sheets according to a predetermined interfolding configuration;

whose main characteristic is that said cutting of said web into said sheets is carried out on a cutting roller configured to alternately distribute said plurality of sheets to said first folding roller forming a first plurality of sheets arranged to reach said folding zone through a first feeding path, and ad a transfer roller of transfer section forming a second plurality of sheets arranged to reach said folding zone through a second feeding path, said transfer roller being configured to transfer said second plurality of sheets to said second folding roller.

According to a further object of the invention, an interfolding machine for producing stacks of interfolded sheets from a web of paper, or similar material, comprises:— a feeding section configured to cause said web of paper to move along a predetermined feeding direction;

a cutting section comprising a cutting roller having an external surface, and a counter-cutting element configured to cooperate with each other in such a way to cut said web of paper in a plurality of sheets of predetermined length;

a folding section comprising a first and a second folding rollers counter-rotating one with respect to the other, said first and second folding rollers being configured to fold, at a folding zone, said plurality of sheets in a plurality of panels and to form said stack of interfolded sheets according to a predetermined interfolding configuration;

wherein a transfer roller is, furthermore, provided configured to alternatively move between a working configuration, in which the cutting roller is arranged to alternately distribute said plurality of sheets to said first folding roller forming a first plurality of sheets arranged to reach said folding zone through a first feeding path, and to said transfer roller forming a second plurality of sheets arranged to reach said folding zone through a second feeding path, said transfer roller being configured to transfer said second plurality of sheets to said second folding roller, and a rest configuration, in which said transfer roller is not arranged to hold said sheets per cui all the sheets of said plurality of sheets are arranged to move from said cutting roller to said first folding roller and therefore to reach said folding zone through said first feeding path only.

In particular, a skilled person in the art will have no difficulties to understand that the features described above and defined by the dependent claims can be applied to the different folding machines described above.

BRIEF DESCRIPTION OF THE DRAWINGS

The invention will now be shown with the following description of its exemplary embodiments, exemplifying but not limitative, with reference to the attached drawings in which.

Figure 1:
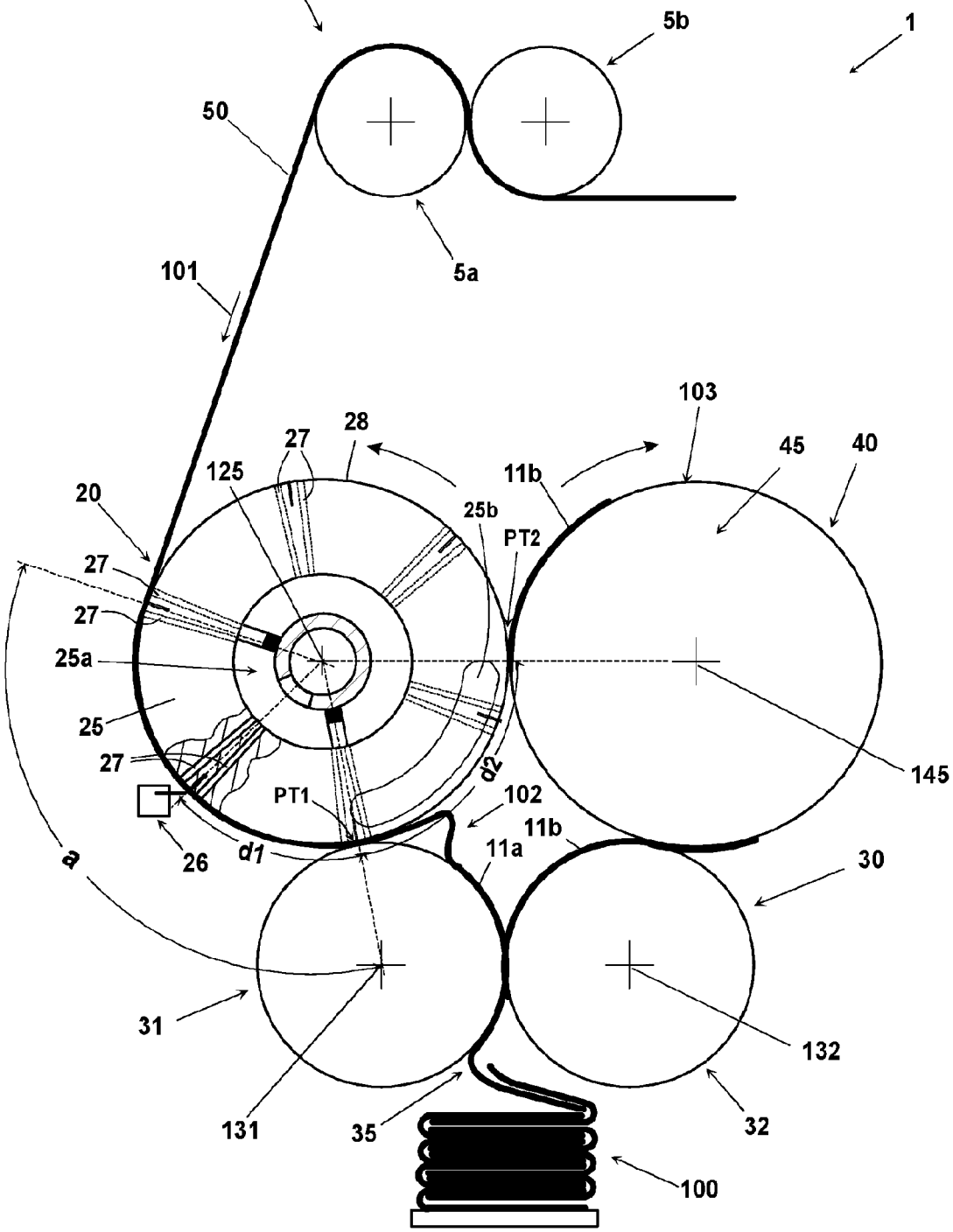
FIG. 1 diagrammatically shows a side elevational view of a first embodiment of the interfolding machine, according to the invention.
Figure 2:
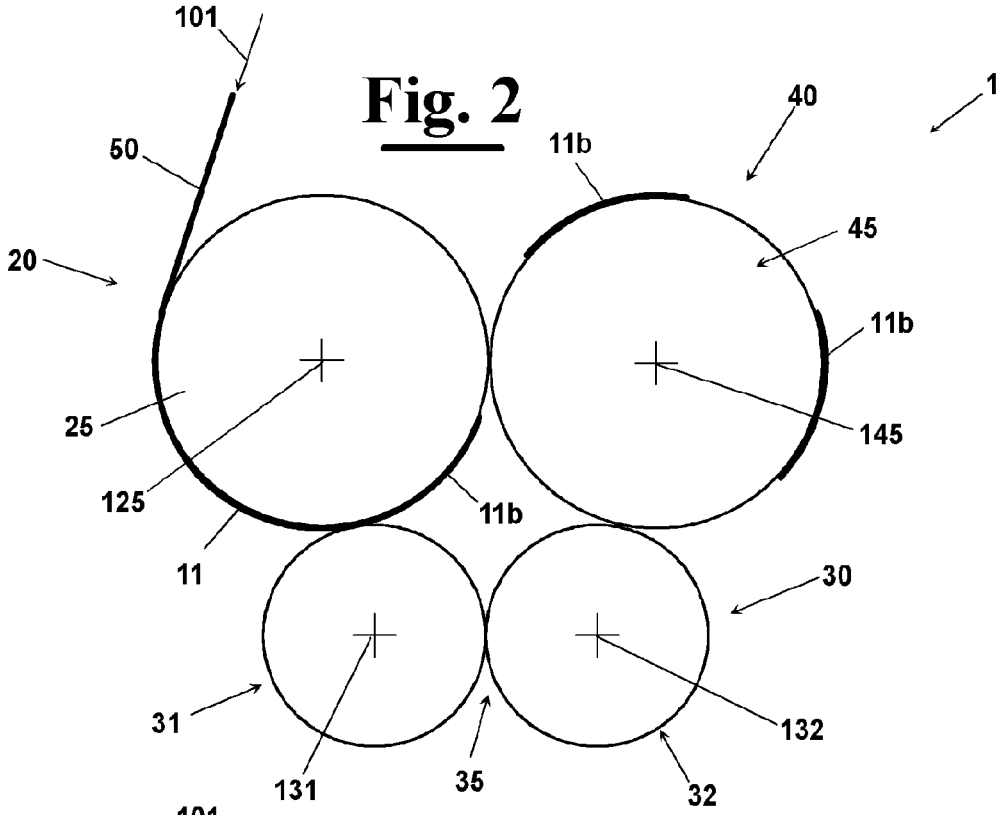
Figure 3:
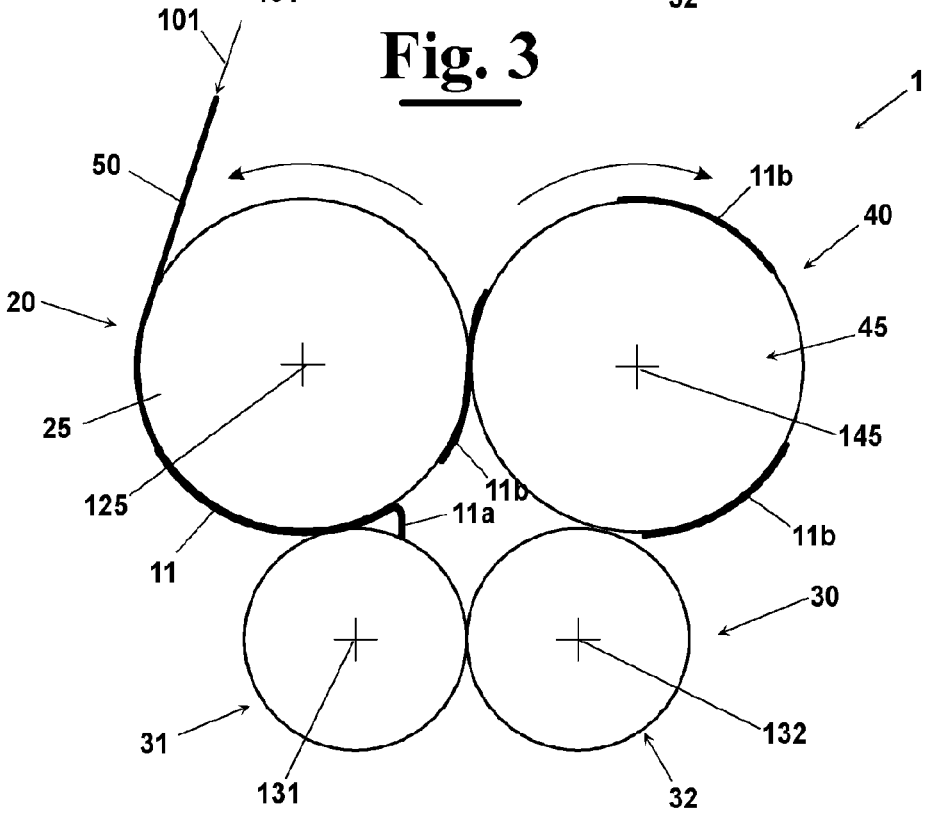
Figure 4:
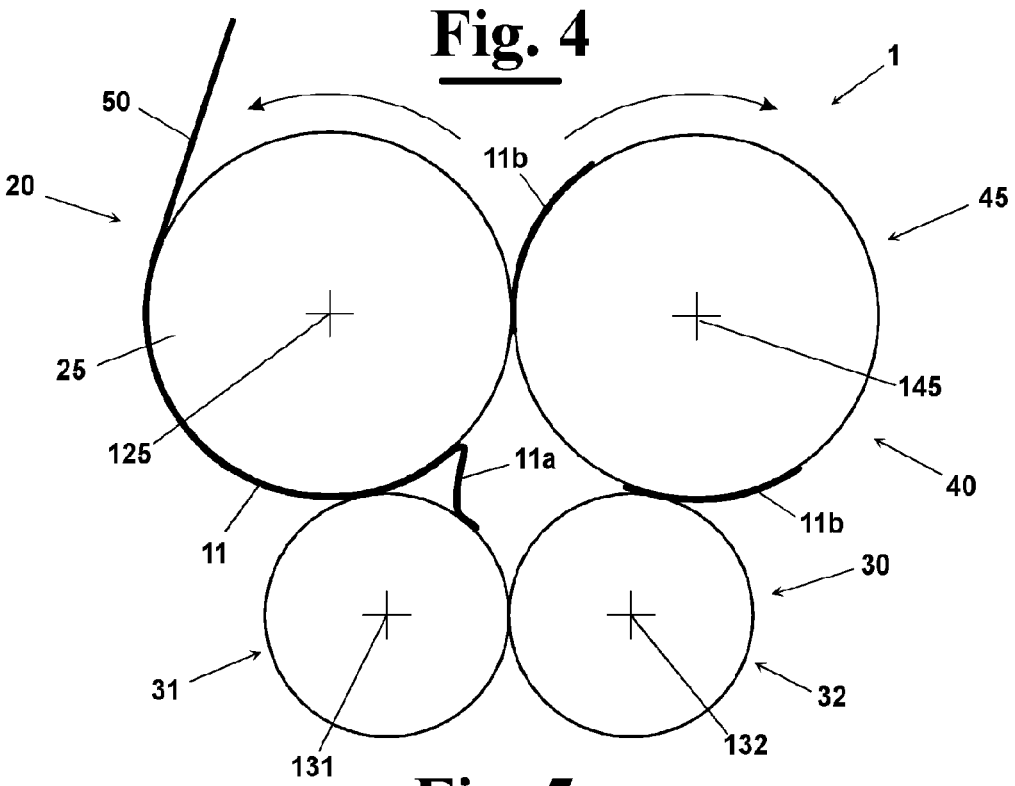
Figure 5:
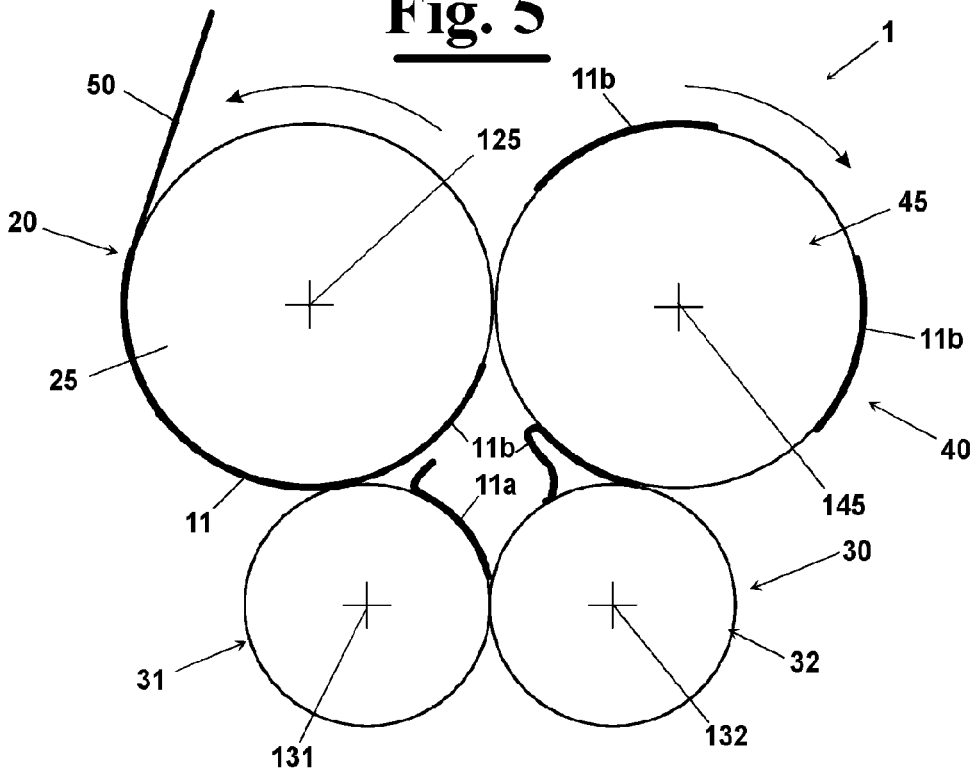
Figure 6:
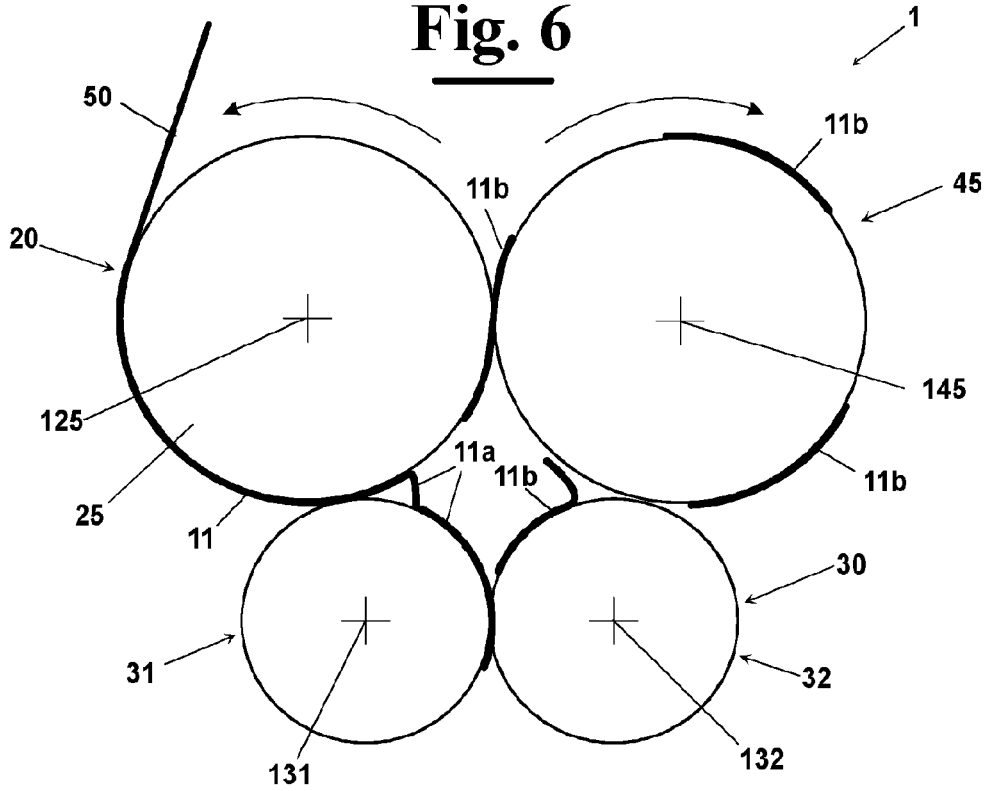
Figure 7:
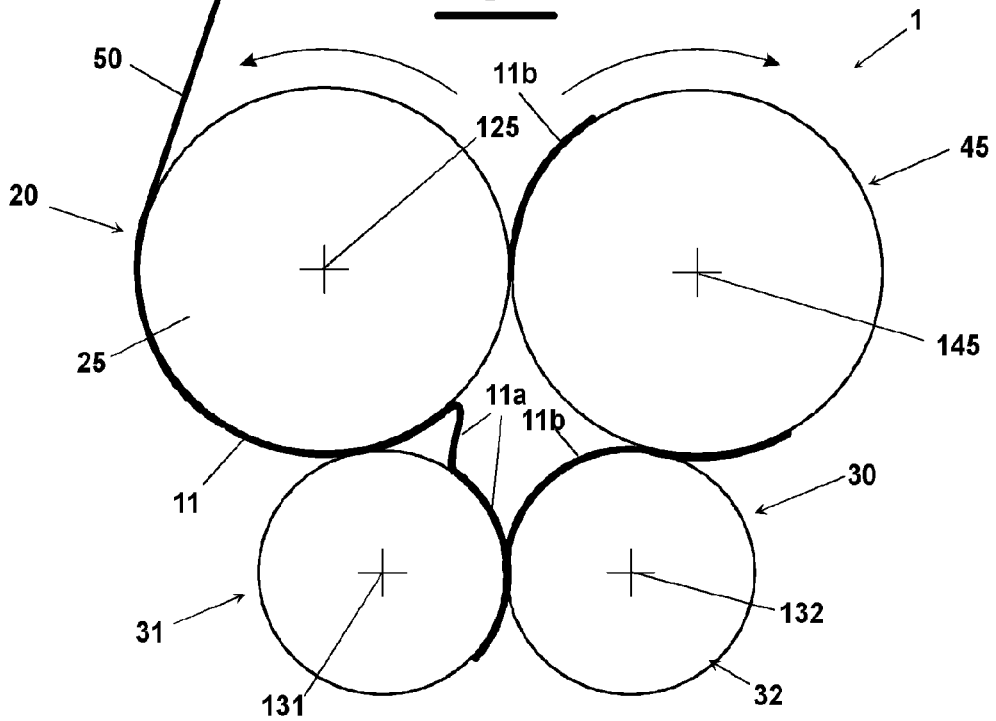

FIGS. from 2 to 10 diagrammatically show a possible sequence of steps that can be carried out by the machine of FIG. 1 for producing stacks of interfolded sheets according to the invention.

DETAILED DESCRIPTION OF SOME EXEMPLARY EMBODIMENTS OF THE INVENTION

With reference to FIG. 1, according to an embodiment of the invention, an interfolding machine 1 for producing stacks 100 of interfolded sheets according to a predetermined interfolding configuration, for example a "V", "Z" or "W", configuration starting from a web 50 of paper, or similar materials, provides a feeding section 10, which, for example by feeding rollers 5*a* and 5*b* provide to apply tension on the web 50 and to move the same along a feeding direction 101 at a predetermined feeding speed.

The feeding section 10 feeds the web of paper 50 to a cutting section 20, in which the web of paper 50 is cut into a series of sheets 11 of predetermined length, at a cutting point positioned between a cutting roller 25 and a counter-cutting element 26. Downstream of the cutting section 20*a* folding section 30 is provided comprising a first and a second folding rollers 31 and 32 counter-rotating one with respect to the other. The first and second folding rollers 31 and 32 are arranged to rotate about respective rotation axes 131, and 132, in such a way to have a first peripheral velocity vP and are configured to fold, at a folding zone 35, the aforementioned plurality of sheets 11 into a plurality of panels, and to form the stack 100 of interfolded sheets. In particular, with the term "panel" it is intended to indicate each portion of sheet that is obtained by folding a sheet 11 a determined number of times.

According to the invention, the cutting roller 25 is configured in such a way to alternately distribute the aforementioned sheets 11 between a transfer roller 45 of a transfer section 40, and the first folding roller 31. More precisely, the sheets 11 which are transferred from the cutting roller 25 to the first folding roller 31 form a first plurality of sheets 11*a* which reach the folding zone 35 through a first feeding path 102. This comprises a first portion d1 of the surface of the cutting roller 25 and a portion of the first folding roller 31.

The sheets 11 which, instead, are transferred from the cutting roller 25 to the transfer roller 45 form a second plurality of sheets 11*b* which reach at the folding zone through a second feeding path 103. In particular, the second feeding path 103 comprises a second portion d2 of the external surface of the cutting roller, a portion of the surface of the transfer roller 45 and a portion of the second folding roller 32. In particular, the cutting roller 25 and the transfer roller 45 can have a circumference of equal length. The cutting roller 25 and the transfer roller 45 are arranged to rotate about respective rotation axes 125, and 145, in such a way to have a second peripheral velocity vT. More in detail, the first peripheral velocity vP of the folding rollers 31 and 32 is equal to half of the second peripheral velocity vT, i.e. vP=½ vT. In the case that is shown in the FIG., the cutting roller 25 and the transfer roller 45 have a circumference having a length that is 6 times the planar development of a sheet 11, i.e. 6 times the cut-off. The first folding roller 31 and the second folding roller 32 have, advantageously, a circumference having a length that is 4 times the length of the planar development of the sheet 11, i.e. 4 times the cut-off. In other embodiments that are not shown for reasons of simplicity, the cutting roller 25 and the transfer roller 45 have a circumference having a length that is a multiple of the length of a panel of the sheet 11. This configuration is particularly advantageous when the sheet 11 has 3, or 4 panels.

In particular, as diagrammatically shown in the FIGS. from 2 to 7, the ratio between the peripheral velocity vT of the cutting rollers 25 and the transfer roller 45, and the peripheral velocity vP of the folding rollers 31 and 32, allows to carry out the interfolding, according to a determined interfolding configuration, of the sheets 11*a* coming from the first feeding path 102 with those 11*b* coming from the second feeding path 103. More precisely, since the peripheral velocity vP of the first folding roller is half of the peripheral velocity vT of the cutting roller 25, each sheet 11 that is transferred to the first folding roller 31 and, therefore, reaches the interfolding zone 35 along the first feeding path 102, is positioned rearward of a position with respect to the sheet 11 which follows the same that is transferred from the cutting roller 25 to the transfer roller 45 and reaches the interfolding zone 35 through the second feeding path 103. In other words, the peripheral velocity vT of the cutting roller 25 is about twice the one of the folding rollers 31 and 32, because the cutting roller 25 has to continuously feed both the folding rollers 31 and 32 with a stream of sheets which will be, therefore, continuous and staggered at the interfolding zone 35. When the peripheral velocity vT of the cutting roller 25 is about twice the vP of the folding rollers 31 and 32, the sheets coming from the first feeding path 102 and those coming from the second feeding path 103 are staggered of half a sheet, thus forming a stack 100 of "V" interfolded sheets that means formed by two panels.

According to an embodiment of the invention it is possible to cause the cutting roller 25 to rotate in such a way to have a peripheral velocity vT higher than the feeding speed of the web of paper 50.

The cut sheets 11 move along the surface of the cutting roller 25 from the cutting point to a first tangent point $PT_1$ positioned between the cutting roller 25 and the first folding roller 31. As diagrammatically shown in FIG. 1, the cutting roller 25 is provided with first holding elements 25*a* configured to hold the sheets 11 on a first portion d1 of the surface of the cutting roller 25 and second holding elements 25*b* configured to hold the sheets 11 on a second portion d2 of the surface of the cutting roller 25. Preferably, as diagrammatically shown for example in FIG. 1, the second holding elements 25*b* can be of pneumatic type, i.e. in communication with a device for generating a determined level of vacuum. In particular, the second holding elements 25*b* can be arranged to hold the sheets solo at predetermined angular positions of the cutting roller 25 during the rotation of the same about its rotation axis 125. Therefore, at the aforementioned predetermined angular positions of the cutting roller 25, the second holding elements 25*b* are arranged to hold the sheets 11 on the second portion d2, and, therefore, a sheet 11 is transferred from the cutting roller 25 to the transfer roller 45, whilst, when the cutting roller 25 is not arranged in the aforementioned angular positions, the second holding elements 25*b* are not arranged to hold the sheets 11 on the second portion d2, and, therefore, the processed sheet 11 is transferred from the cutting roller 25 to the first folding roller 31. Even if it is not shown in detail for reasons of simplicity, the first and second folding rollers 31 and 32 are provided with holding elements configured to hold the sheet 11 on a respective holding portion and, therefore, to leave the same at the aforementioned interfolding zone 35.

More in particular, come diagrammatically shown in FIG. 1, the first portion d1 of the cutting roller 25 extends substantially from the counter-cutting element 26 to a first tangent point PT1 positioned between the cutting roller 25 and the first folding roller 31. Instead, the second portion d2 of the cutting roller 25 extends substantially from the first tangent point PT1 and a second tangent point PT2 positioned between the cutting roller 25 and the transfer roller 45. The sheets 11 can adhere to the portion d1 of the surface of the cutting roller 25, for example, because sucked by a series of suction holes 27 which, at an angular sector corresponding to an angle at the centre $\alpha$ of predetermined magnitude, are put in communication with a vacuum generation device, not shown in the figures, that puts under vacuum the central part of the cutting roller 25. When the sheets 11 reach point $PT_1$ they are no more sucked by the suction holes and, if they have to be fed to the second path 103 as the sheets 11*b* of FIG. 1, they have to continue to adhere to the surface of the cutting roller 25. For this purpose, additional suction holes are provided which work in combination with a shaped hole. This is arranged to put in pneumatic communication the holes with the vacuum generation device at a predetermined position according to a principle that is known in the related field. In particular, the holes are put in pneumatic communication with ducts which extend longitudinally to the cutting roller. Therefore, the hole that is in pneumatic communication with the corresponding duct sucks the sheet 11 on the cutting roller 25 to move the same from the tangent point PT1 to the tangent point PT2 where is transferred on the transfer roller 45 and therefore fed to the interfolding zone 35 along the second feeding path 103 in order to be interfolded with a respective sheet 11*a* that is fed along the first feeding path 102. In a possible embodiment of the invention, not shown in the FIGS. for reasons of simplicity, a device can be provided for adjusting the level of vacuum generated by the aforementioned device for generating a determined level of vacuum. In particular, the aforementioned device for adjusting the level of vacuum can be configured to increase, or decrease the level of vacuum at least of the second holding elements 25*b*.

Downstream of the interfolding zone 35 separation elements can be provided for separating a stack being formed into small stacks 100, in a way that is not shown but that the skilled person is able to carry out for example as described in EP1415945 by folding fingers, or folding arms, or separators, etc.

According to further embodiments that are not shown, the first and/or the second holding elements 25*a*, 25*b* can be of mechanical type. In particular, the first and/or the second holding elements 25*a*, 25*b* can comprise mechanical clamps operated by cams, or other devices arranged to close and open the mechanical clamps according to suitable times and modality. For example, piezoelectric actuators can be used as for example described in WO2019/207434.

Figure 8:
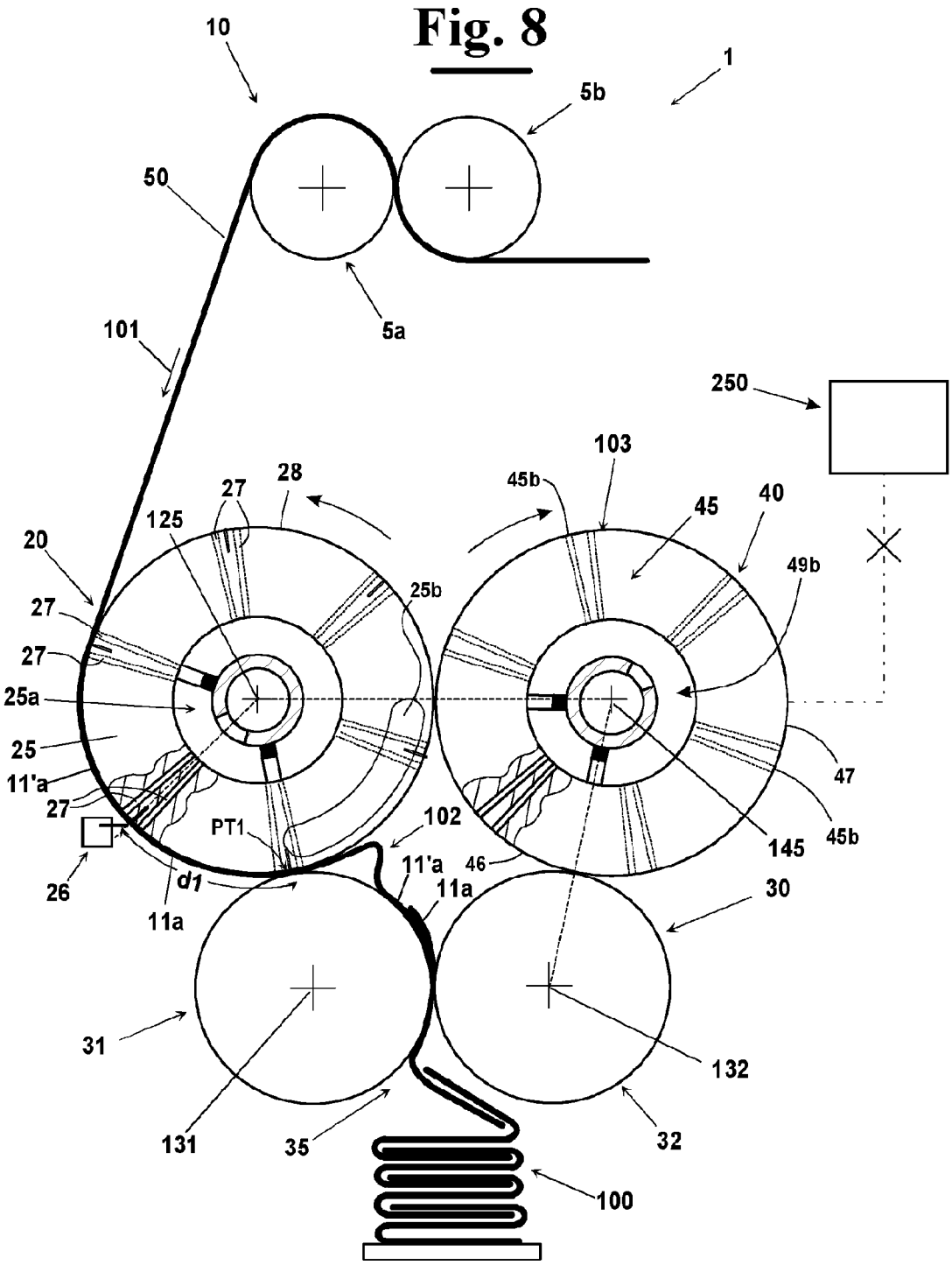

According to an embodiment of the invention that is diagrammatically shown in FIG. 8, the transfer roller 45 is provided with third holding elements 45*b* arranged to hold the sheets on a portion of the external surface 46. In FIG. 8, the portion 47 of the external surface 46 of the transfer roller that extends between the tangent points of the transfer roller 45 with the cutting roller and with the second folding roller 32.

According to an embodiment of the present invention, the third holding elements 45*b* can be configured to alternatively move between an activation configuration, in which the third holding elements 45*b* are arranged to hold the second plurality of sheets 11*b* on the portion 47 of the external surface 46, in such a way to transfer the same from the cutting roller 25 to the second folding roller 32, and a deactivation configuration, in which the third holding elements 45*b* are not arranged to hold the sheets of the second plurality of sheets and, therefore, all the sheets cut by the cutting roller 25 are arranged to be transferred from the cutting roller 25 to the first folding roller 31.

In the example of FIG. 8, the third holding elements 45*b* are of pneumatic type, and, therefore, comprises suction holes 45*b* which are pneumatically connected with a vacuum generation device. In this case, therefore, in the activation configuration, the third holding elements 45*b*, for example suction holes and a suction sector 49*b*, or a bell-shaped vacuum system, are arranged in pneumatic connection with the vacuum generation device, whilst in the deactivation configuration, the third holding elements 45*b* are not arranged in pneumatic communication with the aforementioned vacuum generation device and, therefore, in this configuration they do not hold the sheets 11 cut by the cutting roller 25 that, therefore, all reach the folding, or interfolding, section 35 through the first feeding path. For example, a vacuum generation device can be provided that is operatively connected through a pneumatic circuit only to the suction holes 45*b*. In this case, the activation/deactivation device 250 can be arranged to turn on or off the aforementioned vacuum generation device to arrange the third holding elements 45*b*, respectively, in a deactivation, or activation, configuration.

Figure 9:
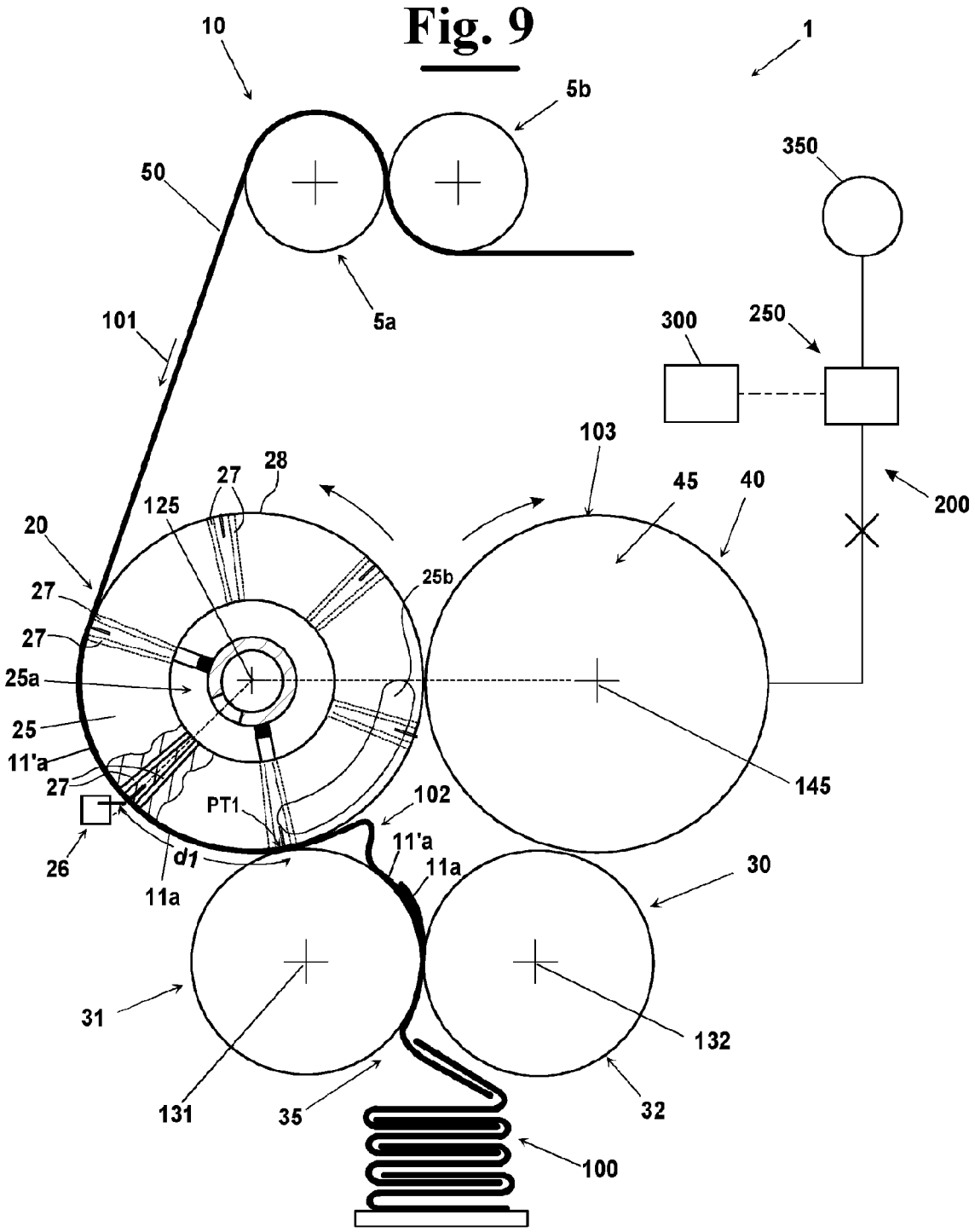

According to an embodiment of the invention, an activation/deactivation device 250 can be provided configured to arrange the aforementioned third holding elements 45*b* in the activation configuration, or alternatively, in the deactivation configuration. In the case in which the third holding elements 45*b* are of pneumatic type, as disclosed above with reference to FIG. 8, the aforementioned activation/deactivation device 250 can be an electro-valve positioned along the pneumatic circuit 200 which connects the vacuum generation device 350 with the suction holes 45*b* and that can be alternatively opened, or closed, for example operated by control unit 300 (FIG. 9).

Figure 10:
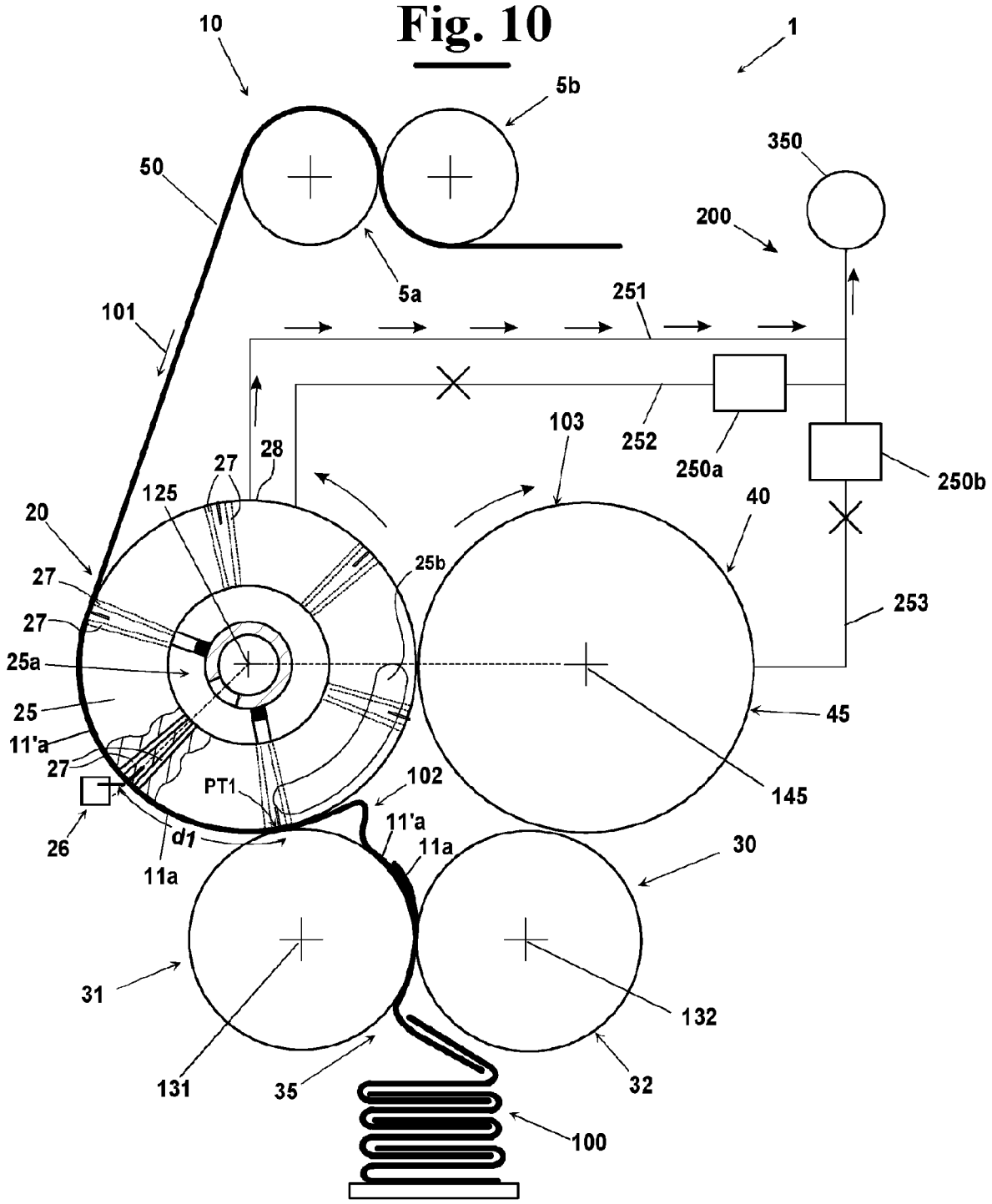

According to an alternative embodiment of the invention, alternatively, or in addition to the third holding elements 45*b* of the transfer roller 45, the second holding elements 25*b* of the cutting roller 25 can be configured to be alternatively positioned in an activation configuration, in which are arranged to hold the sheets on the external surface at the second portion d2, as described above, or in a deactivation configuration, in which they are not arranged to hold the sheets 11 at the second portion d2 of the external surface. For example, analogously to what described above with reference to FIG. 9, the activation/deactivation device 250, diagrammatically shown in FIG. with a rectangular block, can be an electro-valve configured to connect, or disconnect, only the second holding elements 25*b* of the cutting roller 25, or also the third holding elements 45*b* of the transfer roller 45, this case is shown in FIG. 10, in order to arrange the only second holding elements 25*b* of the cutting roller 25, or the second holding elements 25*b* of the cutting roller 25 and the third holding elements 45*b* of the transfer roller 45, in the respective aforementioned activation configuration, or in the aforementioned deactivation configuration. Still in the case of FIG. 10, it is possible to provide a single vacuum generation device 350 pneumatically connected with the first holding elements 25*a* through the branch 251, con the second holding elements 25*b* through the branch 252 and with the third holding elements 45*b* through the branch 253. More in particular, in the example of FIG. 10, a first activation/deactivation device 250*a* for connecting or disconnecting (case shown in FIG. 10) the second holding elements 45*b* with/from the vacuum generation device 350, and a second activation/deactivation device, 250*b* for connecting or disconnecting (case shown in FIG. 10) the third holding elements 45*b* with/from the vacuum generation device 350, are provided.

According to an alternative embodiment not shown in the FIG. for reasons of simplicity, only an activation/deactivation device 250, for example an electro-valve, can be provided arranged to connect, or disconnect, at the same time, the second and the third holding elements 25*b* and 45*b* with/from the vacuum generation device 350.

The embodiments described above in particular with reference to the FIGS. from 8 to 10, allows to obtain a machine that is highly flexible, because it is able to produce both product of single fold type, when the aforementioned third holding elements 45*b* and/or the aforementioned second holding elements 25*b* are arranged in the activation configuration (analogously to what is shown in FIG. 1), and products of multi fold type, i.e. with 3, or 4, panels, when the aforementioned third holding elements 45*b* and/or the aforementioned second holding elements 25*b* are arranged in the aforementioned deactivation configuration (FIGS. 8, 9 and 10) and, therefore, using only the first feeding path 102 to feed the sheets 11 to the folding zone 35. In this case, the overlapping of the sheets 11 is obtained by the difference in the velocity between the velocity vT of the cutting roller 25 and the velocity vP of the folding rollers 31 and 32. In particular, when the velocity vT is about 3/2 of the velocity vP an overlapping of two successive sheets 11 is obtained for ⅓ of their length when the sheets move from the cutting roller 25 to the folding roller 31. More precisely, in this working configuration, the head of the sheet 11 coming from the cutting roller 25 immediately moves on the folding roller 31, whilst the tail of the same sheet, due to the aforementioned difference in the velocities of the cutting roller 25 and the folding roller 31, is lifted forming a bent and, then, falls on the head of the following sheet (see FIGS. 8-10).

Furthermore, the length of each sheet 11, will be such to be folded two times by the folding rollers 31 and 32 obtaining a sheet with three panels overlapped for a panel to the following sheet.

In general, using the first feeding path 102 only, it is possible to obtain a stack 100 of sheets of "multi-fold" type having also more than three panels, i.e. obtained by folding more than two times a single sheet, changing the ratio between the velocity vT and the velocity vP. In any case, the velocity vT is, advantageously, always higher than the velocity vP. By changing the aforementioned ratio of velocity it is possible to change, according to the desired product, also the amount of the overlapping of two following sheets.

According to another embodiment not shown in the FIGS. for reasons of simplicity, the first, the second and the third holding elements 25*a*, 25*b*, 45*b* can be put in pneumatic communication with respective devices for generating vacuum through respective pneumatic circuits. In this case, in order to activate, or deactivate, the first, the second and the third holding elements 25*a*, 25*b*, 45*b* it is possible, respectively, to turn on or off the respective devices for generating vacuum, independently with respect to the others.

In a further embodiment the interfolding machine 1, according to the invention, in the case the second and the third holding elements 25*b* and 45*b* are of pneumatic type, when the third holding elements 45*b* are arranged in the deactivation configuration and, instead, the second holding elements 25*b* of the cutting roller 25 are arranged in the aforementioned activation configuration, these can be advantageously arranged, for example by an adjustment device, not shown in the FIG. for simplicity reasons, in such a way to have a level of vacuum lower than the case in which the third holding elements are arranged in the activation configuration and the machine produces the aforementioned stacks of single-fold sheets.

In another embodiment of the invention not shown in the FIGS. for simplicity reasons, the transfer roller 45 can be arranged in a deactivation configuration simply removing the same, for example by a displacement system, in particular an automatic sliding system, or a carousel, from the working position of FIG. 1. In this case, an activation/deactivation device can be provided arranged to move, as described above, the transfer roller 45 closer to or away from the cutting roller 25.

The foregoing description exemplary embodiments of the invention will so fully reveal the invention according to the conceptual point of view, so that others, by applying current knowledge, will be able to modify and/or adapt for various applications such embodiment without further research and without parting from the invention, and, accordingly, it is therefore to be understood that such adaptations and modifications will have to be considered as equivalent to the specific embodiments. The means and the materials to realize the different functions described herein could have a different nature without, for this reason, departing from the field of the invention. It is to be understood that the phraseology or terminology that is employed herein is for the purpose of description and not of limitation.

The invention claimed is:

1. An interfolding machine for producing stacks of interfolded sheets from a web of paper, said machine comprising:

a feeding section configured to cause said web of paper to move along a predetermined feeding direction;

a cutting section comprising a cutting roller having an external surface, and a counter-cutting element configured to cooperate with each other in such a way to cut said web of paper in a plurality of sheets of predetermined length; and a folding section comprising a first and a second folding rollers counter-rotating one with respect to the other, said first and second folding rollers being configured to fold, at a folding zone, said plurality of sheets in a plurality of panels and to form said stack of interfolded sheets according to a predetermined interfolding configuration;

wherein:

said cutting roller is configured to alternately distribute said plurality of sheets to said first folding roller forming a first plurality of sheets arranged to reach said folding zone through a first feeding path, and to a transfer roller provided in a transfer section forming a second plurality of sheets arranged to reach said folding zone through a second feeding path, said transfer roller is configured to transfer said second plurality of sheets to said second folding roller, said transfer roller is provided with third holding elements configured to hold said second plurality of sheets on the external surface of said transfer roller, and said third holding elements are configured to alternatively move between:

an activation configuration in which said third holding elements are arranged to hold said second plurality of sheets on said external surface of said transfer roller, and a deactivation configuration, in which said third holding elements are not arranged to hold said sheets of said second plurality and, therefore, all the sheets of said plurality are arranged to be transferred from said cutting roller to said first folding roller; and said cutting roller is provided with:

first holding elements configured to hold said sheets on a first portion of said external surface of said cutting roller; and second holding elements configured to hold said sheets on a second portion of said external surface positioned downstream of said first portion of said cutting roller, in such a way that, when said second holding elements are arranged to hold said sheets on said second portion, a sheet of said plurality is transferred from said cutting roller to said transfer roller, whilst, when said second holding elements are not arranged to hold said sheets on said second portion, a sheet is transferred from said cutting roller to said first folding roller.

2. The interfolding machine, according to claim 1, further comprising an activation/deactivation device configured to arrange said third holding elements in said activation configuration, or in said deactivation configuration.

3. The interfolding machine, according to claim 1, wherein:

said second holding elements are configured to move between an activation configuration, in which are arranged to hold said sheets on said second portion, and a deactivation configuration, and said second holding elements are not arranged to hold said sheets on said second portion whereby all the sheets of said plurality are arranged to be transferred from said cutting roller to said folding zone through said first feeding path.

4. The interfolding machine, according to claim 3, wherein an additional activation/deactivation device is provided configured to arrange said second holding elements in said activation configuration, or in said deactivation configuration.

5. The interfolding machine according to claim 1, wherein said cutting roller has a circumference having a length equal to a multiple of the length of a panel.

6. The interfolding machine according to claim 1, wherein said transfer roller has a circumference having a length equal to a multiple of the length of a panel.

7. The interfolding machine according to claim 1, wherein said cutting roller and said transfer roller have circumferences having equal lengths.

8. The interfolding machine according to claim 1, wherein said cutting roller has a diameter equal to the diameter of said first and second folding rollers, or a multiple of the same.

9. The interfolding machine, according to claim 1, wherein said transfer roller has a diameter equal to the diameter of said first and second folding rollers, or a multiple of the same.

10. The interfolding machine according to claim 1, wherein said cutting roller and said transfer roller have a circumference having a length that is six times the length of a sheet of said plurality of sheets.

11. The interfolding machine, according to claim 1, wherein said first and second folding rollers have a circumference having a length that is four times the length of a sheet of said plurality of sheets.

12. The interfolding machine, according to claim 1, wherein said first and second folding rollers are arranged to rotate about a respective rotation axis in such a way to have a first peripheral velocity $v_P$, and wherein said cutting roller and said transfer roller are arranged to rotate about respective rotation axes in such a way to have a second peripheral velocity vT, said first peripheral velocity $v_P$ being less than said second peripheral velocity vT.

13. The interfolding machine, according to claim 12 wherein said first peripheral velocity $v_P$ is equal to half of said second peripheral velocity vT, i.e. vP=½ vT.

14. The interfolding machine, according to claim 2 wherein said prima peripheral velocity $v_P$ is equal to ⅔ of said second peripheral velocity vT, i.e. vP=½ vT.

15. The interfolding machine, according to claim 1, wherein said first and/or said second holding elements are of pneumatic type.

16. The interfolding machine, according to claim 15, wherein said first and second holding elements are suction holes arranged to be selectively put in pneumatic communication with a vacuum generation device to hold said sheets respectively on said first portion d1 and on said second portion of said external surface of said cutting roller.

17. The interfolding machine, according to claim 16, wherein a device for adjusting the level of vacuum generated by said vacuum generation device, in such a way to adjust the level of vacuum at least of said second holding elements.

18. The interfolding machine, according to claim 1, wherein said first and/or said second holding elements are of mechanical type.

19. The interfolding machine, according to claim 1, wherein:

said first portion extends substantially from said counter-cutting element to a first tangent point positioned between said cutting roller and said first folding roller, and said second portion extends substantially from said first tangent point positioned between said cutting roller and said first folding roller and a second tangent point positioned between said cutting roller and said transfer roller.

20. The interfolding machine, according to claim 1, wherein:

said cutting roller comprises a plurality of holes, wherein said first holding elements are configured to put in pneumatic communication said holes with a vacuum generation device at said first portion of said cutting roller to hold on said first portion said sheets arranged to be transferred to said first folding roller, and said second holding elements are configured to selectively put in pneumatic communication said holes with said vacuum generation device at said second portion of said cutting roller to hold on said second portion said sheets arranged to be transferred to said transfer roller.

21. The interfolding machine according to claim 1, wherein said second holding elements of said cutting roller are arranged to hold said sheets on said portion of said external surface of said cutting roller only at predetermined angular positions of said cutting roller during the rotation of the same about its rotation axis, in such a way that:

when said cutting roller is positioned at said predetermined angular positions, said second holding elements are arranged to hold said sheets on said second portion in order to feed a sheet of said plurality from said cutting roller to said transfer roller, whilst, when said cutting roller is not arranged at said predetermined angular positions, said second holding elements are not arranged to hold said sheets on said second portion, and therefore a sheet is transferred from said cutting roller to said first folding roller.

22. A method for producing stacks of interfolded sheets starting from a web of paper comprising:

feeding of said web of paper along a predetermined feeding direction;

cutting of said web of paper in a plurality of sheets of predetermined length;

folding by a first and a second folding rollers counter-rotating one with respect to the other said sheets at a folding zone to form said stack of interfolded sheets interfolded according to a predetermined interfolding configuration;

wherein:

said cutting of said web into said sheets is carried out on a cutting roller configured to alternately distribute said plurality of sheets to said first folding roller forming a first plurality of sheets arranged to reach said folding zone through a first feeding path, and to a transfer roller of transfer section forming a second plurality of sheets arranged to reach said folding zone through a second feeding path, said transfer roller being configured to transfer said second plurality of sheets to said second folding roller, said transfer roller is provided with third holding elements arranged to hold said second plurality of sheets on a respective portion of the external surface of said transfer roller to transfer said second plurality of sheets from said cutting roller to said second folding roller, and in that said cutting roller is provided with:

first holding elements configured to hold said sheets on a first portion of said external surface of said cutting roller; and second holding elements configured to hold said sheets on a second portion of said external surface of said cutting roller positioned downstream of said first portion, in such a way that, when said second holding elements are arranged to hold said sheets on said second portion, a sheet of said plurality is transferred from said cutting roller to said transfer roller, whilst, when said second holding elements are not arranged to hold said sheets on said second portion, a sheet is transferred from said cutting roller to said first folding roller; and deactivating said third holding elements of said transfer roller in such a way that all the sheets of said plurality of sheets are arranged to move from said cutting roller to said first folding roller reaching said folding zone through said first feeding path.

23. The method according to claim 22, further comprising deactivating said second holding elements in such a way that all the sheets of said plurality of sheets are arranged to move from said cutting roller to said first folding roller reaching said folding zone through said first feeding path.

24. An interfolding machine for producing stacks of interfolded sheets starting from a web of paper, said machine comprising:

a feeding section configured to cause said web of paper to move along a predetermined feeding direction;

a cutting section comprising a cutting roller having an external surface, and a counter-cutting element configured to cooperate with each other in such a way to cut said web of paper in a plurality of sheets of predetermined length;

a folding section comprising a first and a second folding roller counter-rotating one with respect to the other, said first and second folding rollers being configured to fold, at a folding zone, said plurality of sheets in a plurality of panels and to form said stack of interfolded sheets according to a predetermined interfolding configuration; and a transfer roller configured to alternatively move between:

a working configuration, in which said cutting roller is arranged to alternately distribute said plurality of sheets to said first folding roller forming a first plurality of sheets arranged to reach said folding zone through a first feeding path, and to said transfer roller forming a second plurality of sheets arranged to reach said folding zone through a second feeding path, said transfer roller being configured to transfer said second plurality of sheets to said second folding roller, and a rest configuration, in which said transfer roller is not arranged to hold said sheets whereby all the sheets of said plurality of sheets are arranged to move from said cutting roller to said first folding roller and therefore to reach said folding zone through said first feeding path only; and said transfer roller is provided with third holding elements configured to hold said sheets on a portion of the respective external surface of said transfer roller, said third holding elements being configured to move between:

an activation configuration, in which are arranged to hold said sheets whereby said transfer roller is arranged in said working configuration, and a deactivation configuration, in which said third holding elements are not arranged to hold said sheets and, therefore, said transfer roller is arranged in said rest configuration.

25. The interfolding machine according to claim 24, further comprising an activation/deactivation device configured to arrange said third holding elements in said activation configuration, or in said deactivation configuration.

26. The interfolding machine according to claim 24, wherein said second holding elements are configured to move between:

an activation configuration, in which said second holding elements are arranged to hold said sheets on said second portion, and a deactivation configuration, wherein said second holding elements are not arranged to hold said sheets on said second portion whereby all the sheets of said plurality are arranged to be transferred from said cutting roller to said folding zone through said first feeding path.

* * * * *